US006176195B1

(12) United States Patent
Gregory

(10) Patent No.: US 6,176,195 B1
(45) Date of Patent: Jan. 23, 2001

(54) BOAT DOCK ASSIST ASSEMBLY

(76) Inventor: Hank Gregory, 85 Hillcrest, Scarborough, Ontario, M1M 1J3 (CA)

( * ) Notice: Under 35 U.S.C. 154(b), the term of this patent shall be extended for 0 days.

(21) Appl. No.: 09/233,964

(22) Filed: Jan. 20, 1999

(51) Int. Cl.[7] ..... B63B 35/44
(52) U.S. Cl. ..... 114/263; 114/230.1
(58) Field of Search ..... 114/263, 230.1, 114/231, 230.14, 230.15, 230.16, 230.17, 230.18, 230.19, 230.27, 44

(56) References Cited

U.S. PATENT DOCUMENTS 4,284,026 * 8/1981 Martinson et al. ..... 114/230.1
4,727,820 * 3/1988 Klaus ..... 114/263

* cited by examiner

*Primary Examiner*—Jesus D. Sotelo

(57) ABSTRACT

A floating boat dock assist assembly has a frame with a substantially V-shaped mouth which is truncated by a flexible rubber tire supported by the frame.

4 Claims, 4 Drawing Sheets

1
3
5
7
9
23
25
27

BOAT DOCK ASSIST ASSEMBLY

FIELD OF THE INVENTION

The present invention relates to a boat dock assist assembly which substantially eases docking of a boat.

BACKGROUND OF THE INVENTION

As anyone who has driven a boat will appreciate, the docking of the boat can be quite awkward. This is particularly true for large sized boats and/or boats which are manned by only one person.

Currently, there are available different types of boat docking assists. One such assist includes a frame having an open region to receive the bow of a boat. Elastic straps are suspended across the open region to gradually slow the speed of the boat as it enters the frame.

Although having some benefit, the above type of construction also suffers from some drawbacks. For example, if the straps are too tight, they can easily snap under the weight of the boat and if they are made too loose they don't have the desired slowing effect on the boat. In addition, over time, elastic straps tend to weaken, losing their effectiveness and/or completely breaking down.

SUMMARY OF THE PRESENT INVENTION

The present invention provides a boat dock assist assembly which is simple in construction while being extremely efficient in operation. More particularly, the boat dock assist assembly of the present invention comprises a frame which has a generally V-shaped mouth which is truncated by a rubber tire supported by the frame.

Unlike prior art constructions, no adjustments are necessary for proper tensioning of the system but rather the natural resiliency of the tire provides a long lasting impact absorbing surface against which the bow of a boat is guided by the V-shaping of the frame mouth.

According to an aspect of the invention, the frame is supported by floats so that it is self supporting in a body of water. It can either be free floating as its own dock or it can be secured to a fixed dock.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
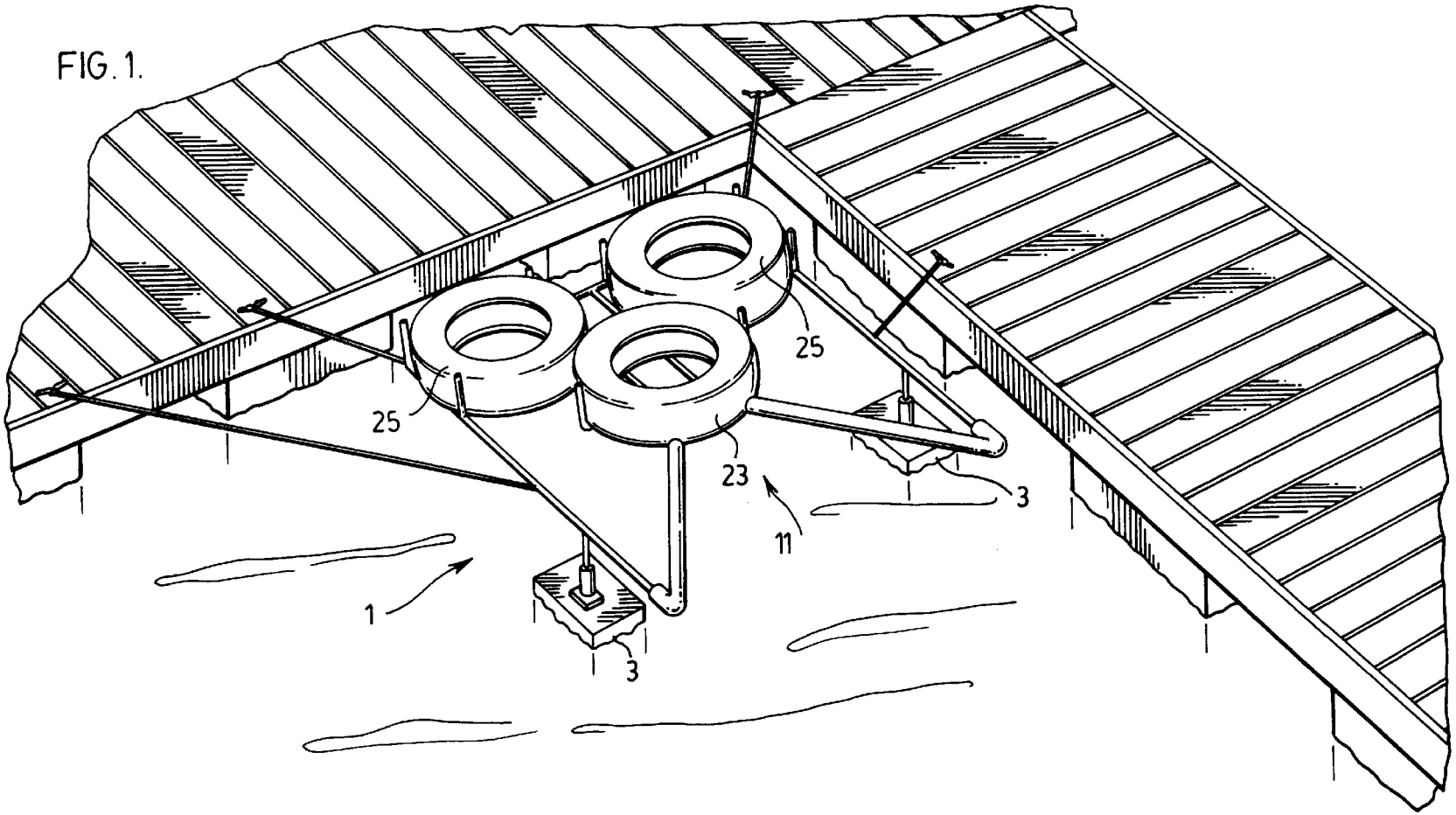
FIG. 1 is a perspective view looking down on a boat dock assist assembly as fixed to a permanent dock according to a preferred embodiment of the present invention.

FIG. 1 shows a boat dock assist assembly generally indicated at 1 which is secured by anchor ropes to a fixed or permanent dock structure. In this particular embodiment, the dock structure simply acts as an anchor but does not provide buoyancy for the system.

Figure 2:
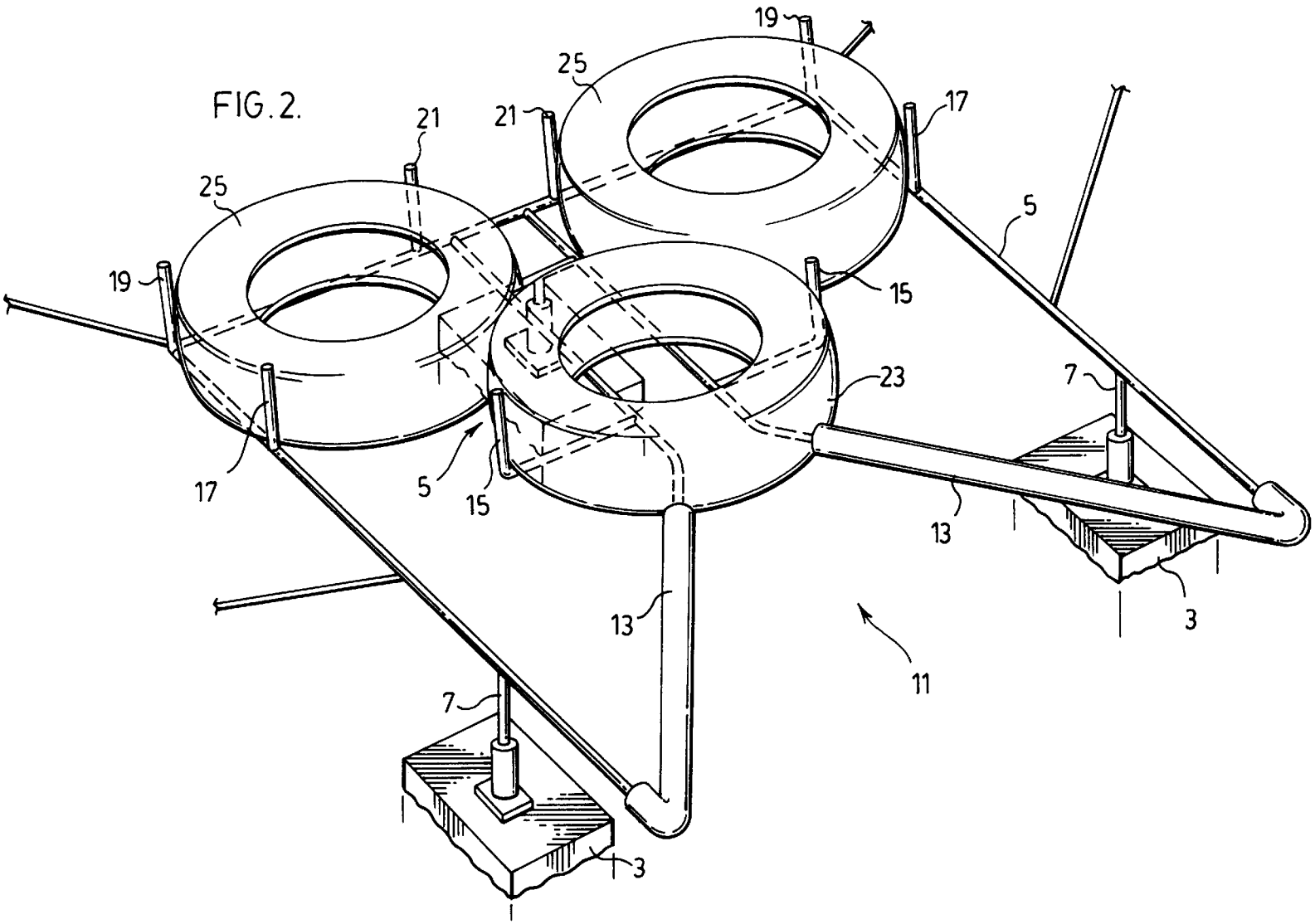
FIG. 2 is an enlarged perspective view of the boat dock assist assembly of FIG. 1.
Figures 5, 6:
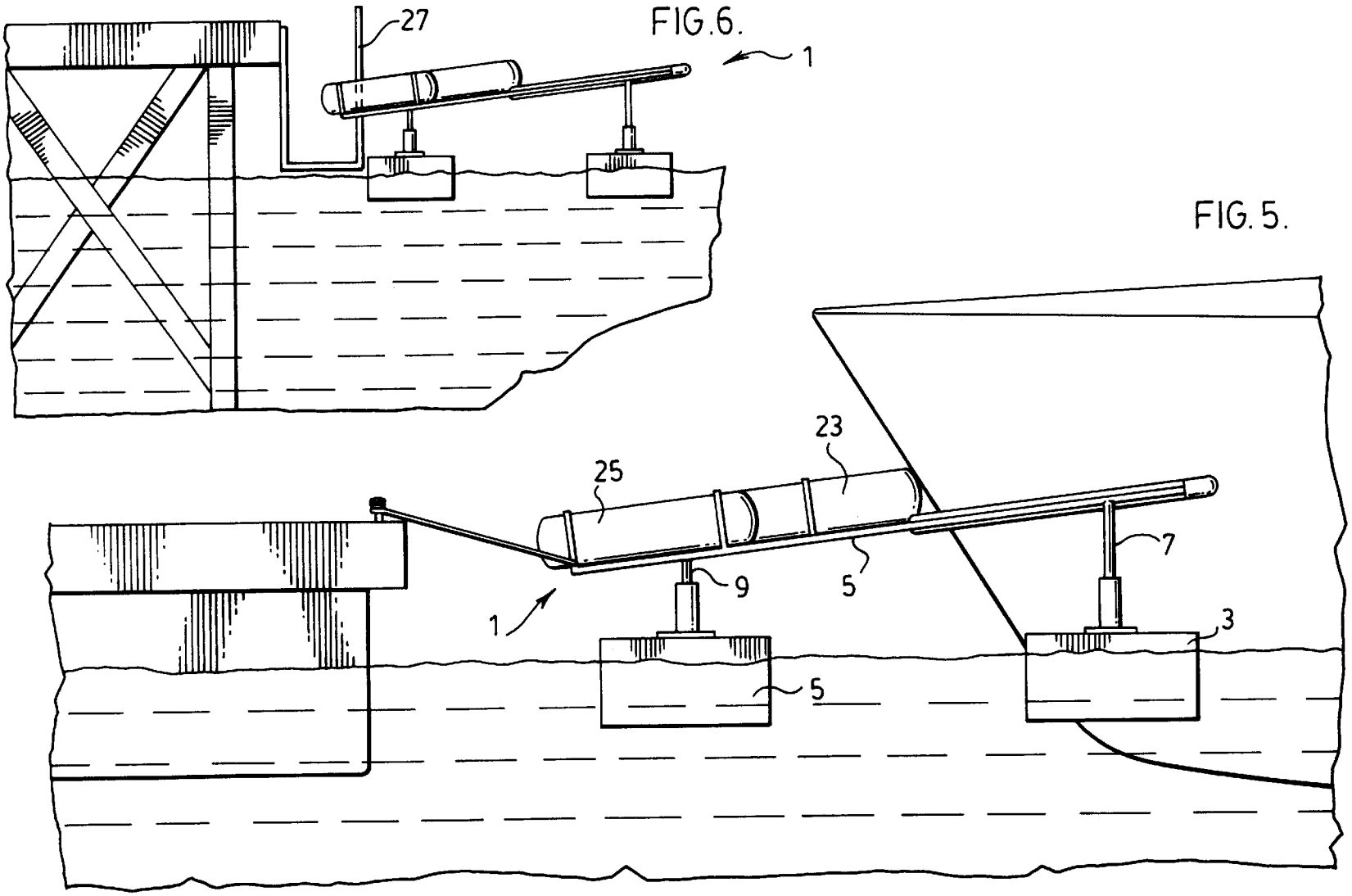
FIG. 5 is a side view of the boat docking assembly of FIG. 2 with the bow of a boat located within the assist assembly.
FIG. 6 shows a boat dock assist assembly according to a further aspect of the present invention.

As better seen in FIGS. 2 and 5 of the drawings, the system is self-buoyant through the provision of a pair of spaced apart floats 3 at the front of the system and a further float 5 positioned generally centrally to the rear of the system.

A rigid frame 5 is held in above water level by the floats. This frame is preferably made from light weight metals or aluminum with a substantially open construction. This minimizes the weight of the frame on the floats keeping the floats themselves relatively small in size.

The frame has a generally triangular front mouth where it is covered by cushioned bumper material 13. Provided atop the frame are three standard rubber automobile tires set in a triangular pattern. Tire 23, which is at the apex of the triangular pattern, truncates the mouth 11 of the frame. The other two tires 25 sit behind and cushion tire 23.

The frame is provided with a pair of upright posts 15 which prevent sideways motion of tire 23 which as noted above, is blocked against rearward movement by, the two tires 25. These two tires are held on the frame by a plurality of posts 17, 19 and 21.

FIG. 5 of the drawings shows that the frame 5 is held above floats 3 by means of upright posts 7 and held above float 5 by an upright post 9. Posts 7 are longer than post 9 giving the frame and the tires atop the frame a downward rearward tilt.

Figure 3:
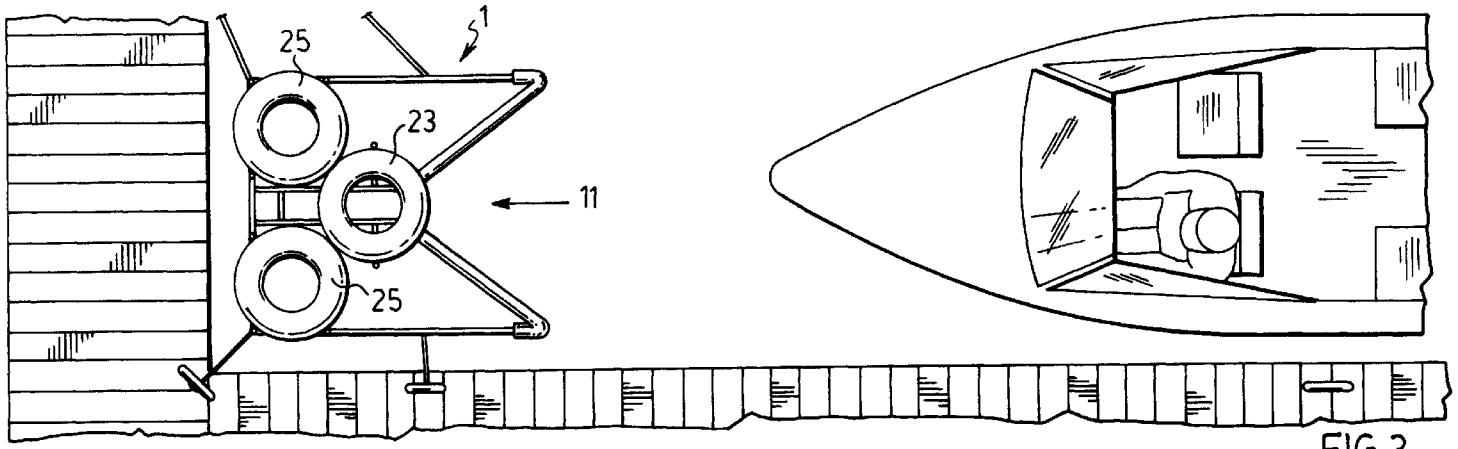
FIGS. 3 and 4 are plan views showing the docking of a boat using the assist assembly of FIG. 1.

FIG. 3 of the drawings shows a boat as it approaches the assist assembly 1. The mouth of the assembly, which is wider than the prow of the bow of the boat acts as a funneling guide as the boat enters the mouth of the frame. Bumper material 13 avoids any contact with the metal construction of the frame.

The bow of the boat is guided directly onto tire 23. This tire cushions the slowing and final stopping of the boat. The cushioning effect of tire 23 is produced both as a result of the rubber construction of the tire and its resilient rearward support from the rubber tires 25.

As will be understood, the rubber construction of all of the tires has an essentially unlimited life span. Furthermore, the cushioning effect provided by the tires does not have to be adjusted for large and small boat sizes but rather is capable of handling the size of any boat that would use the assembly.

Figure 4:
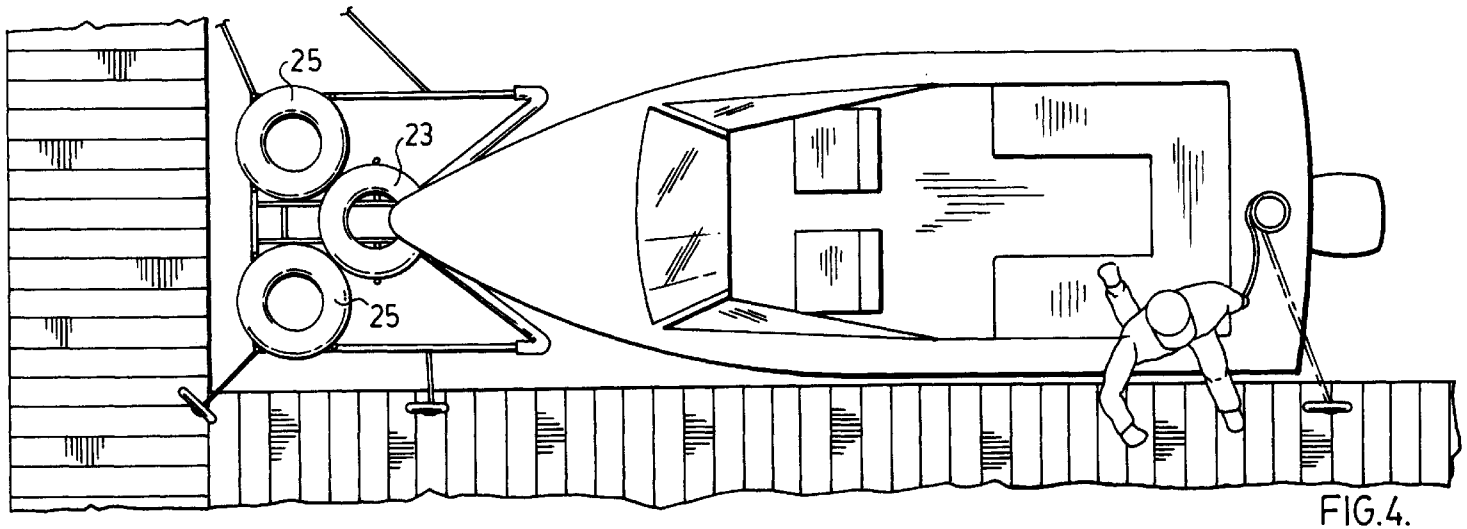

FIG. 4 shows how the system eases one man docking of the boat. Once the bow of the boat has been fully nested as seen in the figure, the operator turns the motor so as to drive the stern of the boat towards the dock while leaving the boat in a slow forward gear to maintain the bow of the boat trapped in the assembly. The boat operator then leaves the boat to tie up to dock which only needs to be done at a single stern location of the boat. The operator then simply shuts the engine down with the boat now fully docked.

As will be appreciated from the above description, the docking of the boat regardless of its size can easily be accomplished by a single individual.

As a result of the downward rearward tilt of the frame and cushioning tires as earlier described, the prow of the boat does not ride up and over tire 23. Rather, the boat tends to push the assembly towards the dock and if the anchoring ropes are not tight enough, the rear of tires 23 will impact in a cushioning manner with the dock.

As a result of the boat dock assembly having its own floats, it travels up and down with the water level rather than being held at a fixed height. In the embodiment shown in FIGS. 1 through 5, the ropes are used to anchor the assembly to the dock. FIG. 6 of the drawings shows that the dock itself can be provided with a U-shaped bracket 27 with one leg of the U fitted through the open frame of assembly 1. This allows the assembly to move up and down with the water level without having to anchor it by means of ropes or the like to the dock.

Although various preferred embodiments of the present invention have been described in detail, it will be appreciated by those skilled in the art that variations may be made without departing from the spirit of the invention or the scope of the appended claims.

What is claimed is:

1. A boat dock assist assembly comprising a frame having a forwardly opening substantially U-shaped mouth which is truncated by a rubber tire supported by said frame, said assist including floatation means comprising a plurality of floats including a pair of floats spaced form one another to opposite sides of said assembly beneath said mouth of said frame.

2. A boat dock assist assembly as claimed in claim 1, wherein said frame comprises metallic tubing and wherein said mouth of said frame is padded.

3. A boat dock assist assembly as claimed in claim 1, wherein said frame is angled rearwardly downwardly.

4. A boat dock assist assembly comprising a plurality of spaced apart floats for floating said assembly in a body of water, a metallic tubing frame elevated from said floats and a triangular array of rubber tires supported by said frame, said frame having a substantially V-shaped padded mouth which is truncated by one of said tires.

* * * * *